US009566534B1

(12) United States Patent
Sufer

(10) Patent No.: US 9,566,534 B1
(45) Date of Patent: Feb. 14, 2017

(54) USER INTERFACE

(71) Applicant: WowWee Group Ltd, Hong Kong (CN)

(72) Inventor: Davin Sufer, Montreal (CA)

(73) Assignee: WowWee Group Ltd, Hong Kong (HK)

( * ) Notice: Subject to any disclaimer, the term of this patent is extended or adjusted under 35 U.S.C. 154(b) by 0 days.

(21) Appl. No.: 14/590,399

(22) Filed: Jan. 6, 2015

Related U.S. Application Data

(60) Provisional application No. 61/923,945, filed on Jan. 6, 2014.

(51) Int. Cl.
*A63H 29/06* (2006.01)
*A63H 29/22* (2006.01)

(52) U.S. Cl.
CPC ..... *A63H 29/22* (2013.01)

(58) Field of Classification Search
None
See application file for complete search history.

(56) References Cited

U.S. PATENT DOCUMENTS 4,946,416 A * 8/1990 Stern ..... A63H 17/34 446/175
5,110,314 A * 5/1992 Fujihara ..... A63H 27/12 446/34
5,606,494 A * 2/1997 Oshima ..... A63F 13/00 345/158
5,635,903 A * 6/1997 Koike ..... A63H 17/34 340/384.1
6,354,842 B1 * 3/2002 Frei ..... 434/365
6,672,935 B1 * 1/2004 Lund ..... A63H 11/08 446/175
6,705,873 B2 * 3/2004 Higashida ..... 434/393
7,056,185 B1 * 6/2006 Anagnostou ..... 446/456
7,291,054 B2 * 11/2007 Choi ..... 446/454
7,901,265 B1 * 3/2011 Cameron ..... A63H 3/46 446/330
8,715,034 B1 * 5/2014 Wong ..... 446/454
8,818,571 B1 * 8/2014 Iida et al. ..... 701/2
2004/0015266 A1 * 1/2004 Skoog ..... B25J 5/007 700/245
2005/0048869 A1 * 3/2005 Osawa ..... A63H 1/06 446/250
2006/0099882 A1 * 5/2006 Eckerman ..... A63H 17/395 446/436
2007/0042673 A1 * 2/2007 Ishihara et al. ..... 446/409
2009/0173561 A1 * 7/2009 Moriguchi ..... B25J 5/007 180/167
2010/0082204 A1 * 4/2010 Kikuchi ..... B25J 5/007 701/41
2010/0099331 A1 * 4/2010 Yang ..... 446/465
2013/0084765 A1 * 4/2013 Pak ..... A63H 17/00 446/7

* cited by examiner

*Primary Examiner* — Tramar Harper
(74) *Attorney, Agent, or Firm* — Merchant & Gould P.C.

(57) ABSTRACT

A user interface system for a toy includes a power drive unit, an encoder and a processor coupled with the power drive unit and with the encoder. The power drive unit actuates a drive element of the toy according to moving instructions received from the processor. The encoder detects motion of the drive element, and the processor sets a mode of operation of the toy according to the motion of the selected drive element and the moving instructions.

3 Claims, 3 Drawing Sheets

USER INTERFACE

This application claims benefit of Ser. No. 61/923,945, filed 6 Jan. 2014 and which application is incorporated herein by reference. To the extent appropriate, a claim of priority is made to the above disclosed application.

FIELD OF THE DISCLOSED TECHNIQUE

The disclosed technique relates to user interfaces, in general, and to a method and a system for receiving instructions from a user, without a dedicated user interface physical means, in particular.

BACKGROUND OF THE DISCLOSED TECHNIQUE

User interfaces are known in the art, usually they include push buttons, knobs, proximity sensors, visual sensor, audible sensors and the like. Other types of user interfaces includes touch screens, which can be modified to present availability for various functionalities, based on temporal information presented to the user (e.g., a pushbutton, a slider).

SUMMARY OF THE PRESENT DISCLOSED TECHNIQUE

It is an object of the disclosed technique to provide a novel method and system for moving a moving body part of a dancing toy in accordance with played music. In accordance with an embodiment the disclosed technique, there is thus provided a user interface system for a toy apparatus. The system includes a power drive unit, an encoder, and a processor coupled with the power drive unit and with the encoder. The power drive unit actuates a drive element of the toy apparatus according to moving instructions received from the processor. The encoder detects motion of the drive element. The processor sets a mode of operation of the toy apparatus according to the motion of the selected drive element and the moving instructions.

In accordance with another embodiment the disclosed technique, there is thus provided a method for receiving user instructions for operating a toy apparatus. The method includes the steps of detecting motion of a selected drive element, extracting external drive element motion characteristics, identifying a predetermined set of drive element motion characteristics, and setting a mode of operation of the toy apparatus. The external drive element motion characteristics are initiated by an external force, external to the toy apparatus. The external drive element motion characteristics are extracted from the motion of the selected drive element according to moving instructions provided to a power drive unit of the toy apparatus. The predetermined set of drive element motion characteristics is identified in the external drive element motion characteristics. The mode of operation of the toy apparatus is associated with the predetermined set of drive element motion characteristics.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

Figure 1:
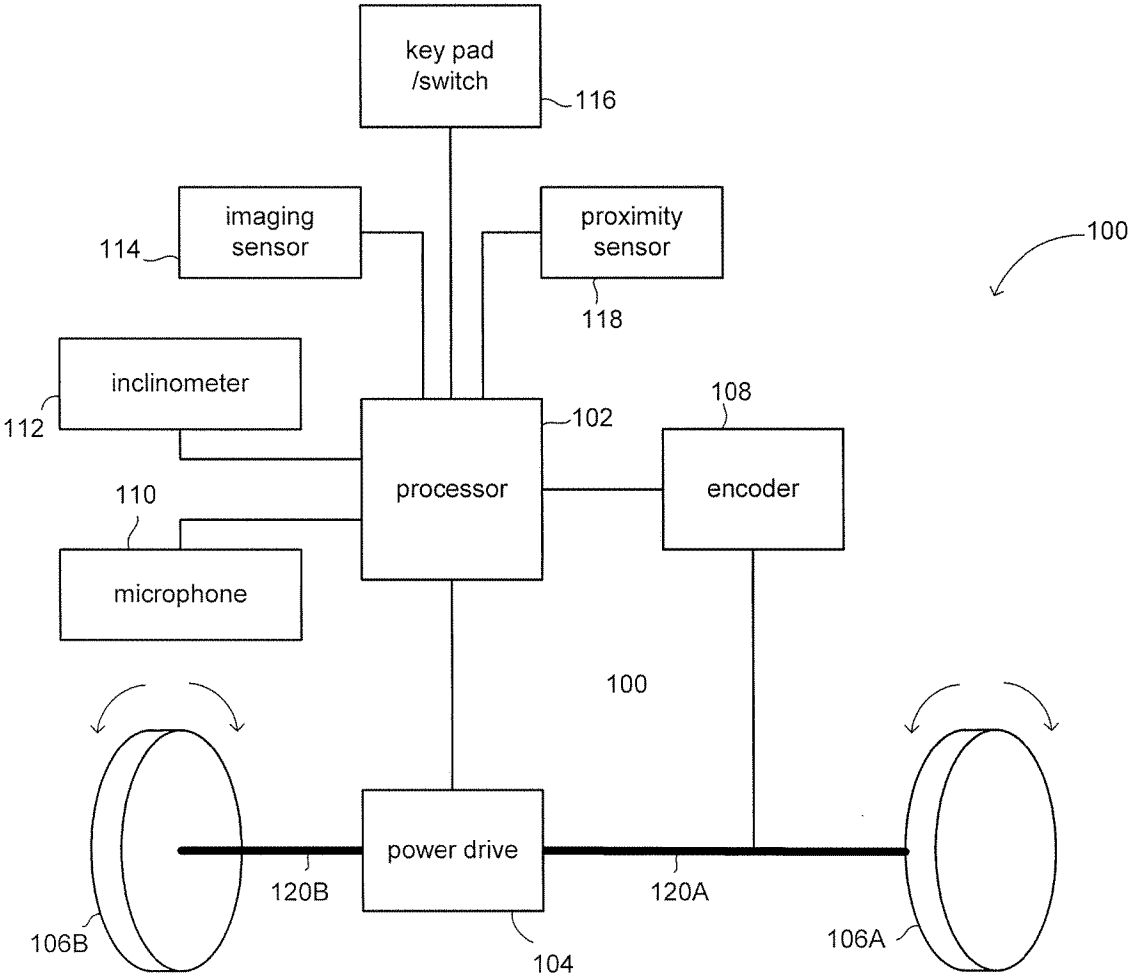
FIG. 1 is a schematic illustration of a power driven system, constructed and operative in accordance with an embodiment of the disclosed technique.

The disclosed technique overcomes the disadvantages of the prior art by providing a method and system for receiving instructions from a user via drive means, such as a wheel or a mechanical limb. Reference is now made to FIG. 1, which is a schematic illustration of a power driven system, constructed and operative in accordance with an embodiment of the disclosed technique. System 100 includes a processor 102, a power drive 104, one or more drive wheels 106A & 106B, an encoder 108, a microphone 110, an inclinometer 112, an imaging sensor 114, a keypad 116 and a proximity sensor 118.

Processor 102 is coupled with power drive 104, drive wheels 106A & 106B, encoder 108, microphone 110, inclinometer 112, imaging sensor 114, keypad 116 and proximity sensor 118. Power drive 104 is coupled with drive wheels 106A and 106B via drive shafts 120A and 120B, respectively. Encoder 108 is further coupled with drive shaft 120A for measuring kinetic properties thereof (e.g., position, angular velocity, angular acceleration). It is noted that encoder 108 can further be coupled with drive shaft 120B, for example, in case relative movement is allowed between drive shaft 120A and drive shaft 120B.

Power drive unit 104 can be configured to utilize a verity of principles, such as electric drive, magnetic drive, mechanical drive (e.g., spring loaded or inertial), pneumatic drive, combustion type drive and the like. It is further noted that general purpose accelerometers (i.e., which can measure shakes or falls) and gyroscopes (i.e., which can measure rotational velocity) can be used for system 100, either replacing inclinometer 112 or in addition thereto. Hence optionally, three dimensional gyroscopes can further be used to provide more ways for receiving mode selection instructions from the user.

Processor 102 receives data relating to the inclination of the system 100, from inclinometer 112 and in turn can instruct power drive unit 104 to move drive wheels 106A and 106B either forward, backward or in opposite direction, as required for the operation of system 102 (e.g., to cause a displacement from one point to another or from one direction to another, to keep it balanced). Processor 102 also receives data relating to sounds in the vicinity of system 100 (e.g., voice commands from the user) from microphone 112. Processor 102 further receives video information from the vicinity of system 100, from imaging sensor 114. Processor 102 may further receive instructions from the user, using keypad/switch 116. According to the disclosed technique, processor 102 may also receive information regarding the proximity of objects thereto, either in a directional manner or in an omnidirectional manner.

Encoder 108 can be replaced with any device that can detect motion characteristics of the drive wheel (i.e., or any motion drive element used in a given system), either hard linked to the drive wheel or semi linked to the drive wheel (e.g., friction type, pressure type, flow type) or even remote sensing the motion thereof by electromagnetic, optical or other means.

According to an embodiment of the disclosed technique, processor 102 also receives information relating to the position and movement of drive wheel 106A and optionally also of drive wheel 106B. Since processor 102 controls power drive unit 104, it may determine if drive wheel movement detected by encoder 108 was caused due to power transferred to drive wheel 106A via the respective drive shaft 120A or by a force, external to system 100, such as the hands of a user.

Accordingly, a code can be determined, similar to a rotational combination code known for vaults. For example, rotating drive wheel 106A (i.e., while power drive unit is inactive with respect to that drive wheel) clockwise, for 180 degrees, can be predetermined as receiving instructions to move system to random movement mode, within 5 seconds or when system 100 is placed back on the surface untouched. Similarly, rotating drive wheel 120 degrees counter clockwise, can be predetermined as receiving instructions to move system 100 to moving back and forth at the beat of music detected by microphone 110. Many other more complex combinations can be determined for system 100 and identified by processor 102, with the various elements of clockwise movement, stops, counterclockwise movement, relative movement (i.e., between drive wheels 106A and 106B), the amount of rotation (e.g., in degrees or portions of a full rotation). For example, moving the system into combat mode (i.e., where it fights a similar unit or a user) can be initiated by the user, by executing the following combination: [Rotate clockwise]→[stop]→[rotate clockwise]→[stop]→[rotate counterclockwise].

According to another embodiment of the disclosed technique, the drive element is in the configuration of a limb (i.e., instead of wheels). Robotic systems often use leg-like limbs for transporting from one point to another. According to the disclosed technique, a certain change of limb configuration, can be predetermined by the system to indicate a user instruction to move from one mode of operation to another. For example, when a leg-like limb is straight and the user bends it to be at a right angle, an encoder monitoring the configuration of the leg, reports this configuration change to the processor. The processor in turn, detects that this configuration change was not initiated by a power drive, but by a force external to the system (e.g., by the hands of the user) and as such, this particular configuration change indicates an instruction received from the user to move the system from one mode of operation to another.

Figure 2:
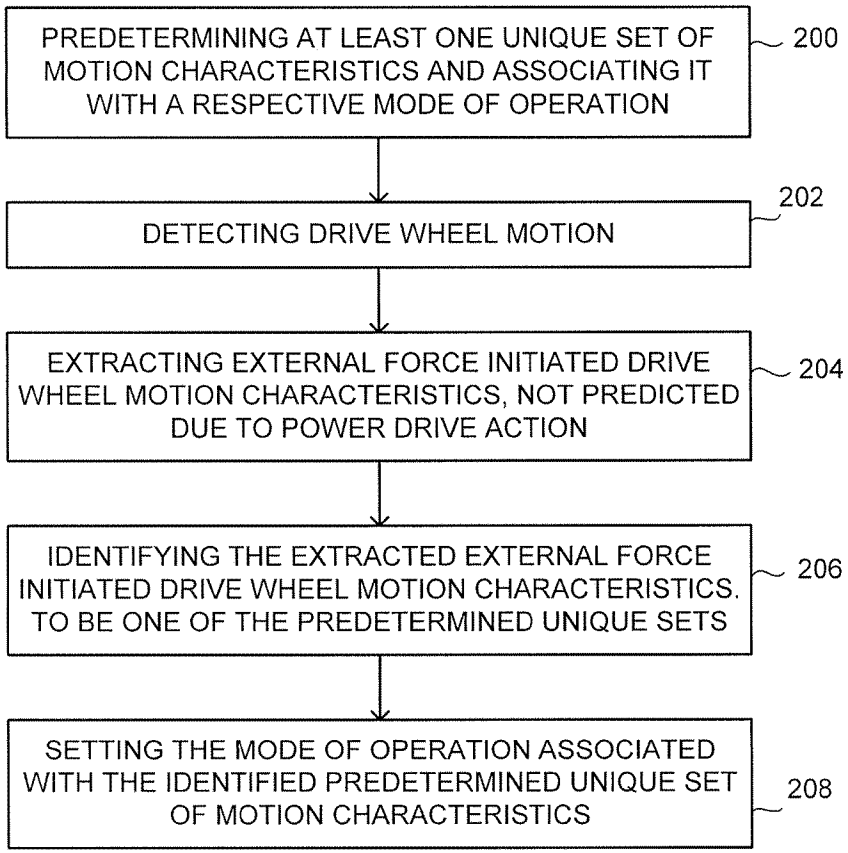
FIG. 2 is a schematic illustration of a method for utilizing a drive wheel, as a user interface input device, operative in according to another embodiment of the disclosed technique.

Reference is now made to FIG. 2 which is a schematic illustration of a method for utilizing a drive wheel, as a user interface input device, operative in according to another embodiment of the disclosed technique. The method is directed at using a drive element such as a drive wheel, a tank tread or a mechanical limb, for receiving instructions from a user, for example, to change the mode of operation (or a feature thereof).

The following method description shall be directed at drive wheels, but as would be appreciated by those skilled in the art, it can be adapted for any drive element, such as tank treads and mechanical limbs. According to a further embodiment of the disclosed technique, this method can further be adapted for virtual environments, where for example, a virtual drive wheel is being turned by a user, using a virtual reality glove.

In procedure 200, at least one unique set of drive element motion characteristics is predetermined, and further associated with a respective mode of operation. The motion characteristics are derived from the operations and degrees of freedom, relating to the drive element. A drive wheel or a tank tread, can be turned in at least two directions, at various angles, angular speeds and accelerations. A limb can be manipulated according to its configurations, based on the number and type of each joint thereof (e.g., single dimension, two dimensions, three dimensions, rotating, sliding, combined). Optionally, according to a further embodiment of the disclosed technique, an additional parameter can be added to table one, such as the identity of the drive wheel (or mechanical limb), by which the user enters a combination, where identical combinations shall be associated with different modes, provided that one is entered by the user through a first drive wheel and the other is entered by the user through a second drive wheel. Such an example is hereby provided with reference to mode 2 and mode 3.

TABLE 1

| Mode ID | Mode Description | Motion Characteristics Set | Drive Wheel |
|---|---|---|---|
| Mode 1 | Random movement | [Turn 90° clockwise]→ [Rest for 3 seconds] | Any |
| Mode 2 | Dance type A | [Turn 90° counter clockwise]→ [Rest for 0.5-1 second]→ [Turn 90° clockwise]→ [Rest for 3 seconds] | First (106A) |
| Mode 3 | Dance type B | [Turn 90° counter clockwise]→ [Rest for 0.5-1 second]→ [Turn 90° clockwise]→ [Rest for 3 seconds] | Second (106B) |
| Mode 4 | Programmable | [Turn 180° clockwise]→ [Rest for 3 seconds] | Any |
| Mode 5 | Combat (user) | [Turn 45° counter clockwise]→ [Rest for 0.5-1 second]→ [Turn 135° clockwise]→ [Rest for 3 seconds] | Any |
| Mode 6 | Combat (rival unit) | [Turn 45° counter clockwise]→ [Rest for 0.5-1 second]→ [Turn 135° counter clockwise]→ [Rest for 3 seconds] | Any |
| Mode 7 | Keep Fixed Distance From Object | [Turn 30° clockwise]→ [Turn 30° counter clockwise]→ [Turn 30° clockwise]→ [Turn 30° counter clockwise]→ | Any |

In procedure 202 a drive element motion is being detected. With reference to FIG. 1, the motion of drive wheel 106A is detected by encoder 108, wherein both are coupled with drive shaft 120A. It is noted that the encoder can alternatively be coupled with a transmission module (not shown) rotating at a ratio other than 1:1 with respect to the drive wheel.

In procedure 204, external force initiated drive element motion characteristics are extracted. Since the processor controls the power drive, it can predict the motion caused in the drive wheel, due to the operation of the power drive. Any motion that exceeds that prediction, is assumed to be caused by an external force. That force is presumed to be the user, providing instructions to the system. These external force initiated drive wheel motion characteristics may include angular position, angular displacement, angular speed, angular acceleration and the like. It is noted that as mentioned above, the nature of the drive element (e.g., drive wheel, drive tank tread, mechanical limb) determines the motion characteristics.

In procedure 206, an attempt is made to identify the extracted external force motion characteristics, as one of the unique set of drive element motion characteristics, predetermined in procedure 200. If an identification is successful, then the system proceeds to procedure 208. Otherwise, the system returns (not shown) to procedure 202.

In procedure 208, the system is set to the mode associated with the positively identified unique set of drive element motion characteristics.

Figure 3C:
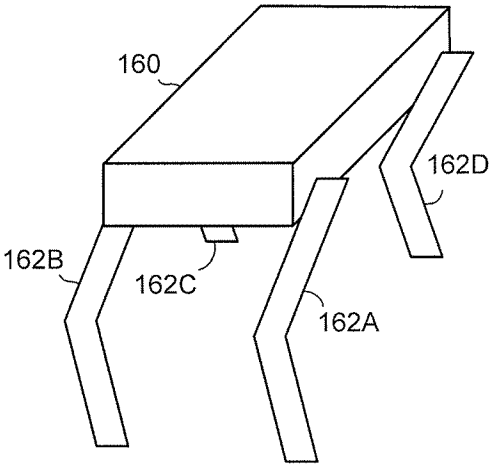
FIGS. 3B and 3C illustrate other example physical configurations available for implementing embodiments according to the disclosed technique.
Figure 3B:
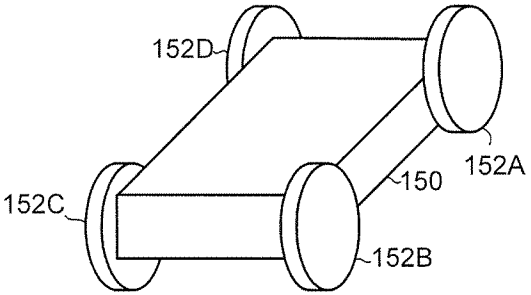
Figure 3A:
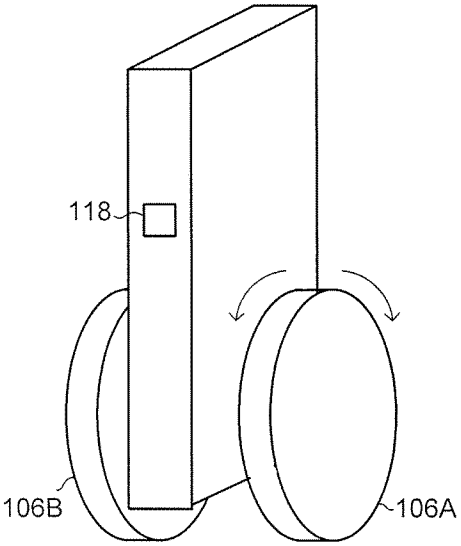
FIG. 3A illustrates an example physical configuration for the system of FIG. 1.

Reference is now made to FIGS. 3A, 3B and 3C. FIG. 3A illustrates the possible configuration for system 100 of FIG. 1. Here, the drive wheels 106A and 106B are located side by side and the system needs to move forwards and backwards to keep a balance, using inclinometer 112 or similar motion/position/orientation sensing units, such as gyroscopes, accelerometers and the like. FIG. 3A also illustrates the position of proximity sensor 118, which for example can be used to execute Mode 7 of Table 1, wherein the user holds his hand at a distance from proximity sensor and the system attempts to maintain a fixed distance from the hand of the user. Accordingly, if the user moves his hand away from proximity sensor 118, the system would follow the hand of the user and if the user shall move his hand closer to proximity sensor 118, then the system shall move away from the hand of the user.

FIG. 3B illustrates another possible configuration for a system according to the disclosed technique, which is in the form of a convention car 150, having four wheels 152A, 152B, 152C and 152D. According to the disclosed technique, using a drive wheel as an input to receive user instructions, can be limited to one or more specific drive wheels, or can be determined for all of the drive wheels.

FIG. 3C illustrates a further possible configuration for a system according to the disclosed technique, which is in the form of a mechanical limb driven system, having (but not limited to) four limbs 162A, 162B, 162C and 162D. According to the disclosed technique, using a mechanical limb as an input to receive user instructions, can be limited to one or more specific mechanical limbs, or can be determined for all of the drive wheels.

It will be appreciated by persons skilled in the art that the disclosed technique is not limited to what has been particularly shown and described hereinabove. Rather the scope of the disclosed technique is defined only by the claims, which follow.

The invention claimed is:

1. A self-balancing robotic toy comprising:

two parallel wheels in a single axis, said wheels being free of contact with any other parts of said toy in contact with a surface when activated;

a power drive unit, said power drive unit being independently coupled to each of said two wheels at a lower end of said robotic toy;

at least one motion encoder, said at least one motion encoder positioned for detecting position and motion of said two wheels and said power drive unit;

at least one position sensor being positioned at a determined distance above said wheels, said at least one position sensor being selected from the group consisting of inclinometers, gyroscopic sensors and inertial sensors;

at least one proximity sensor; and a processor coupled with said power drive unit and with said at least one motion encoder, said at least one position sensor and said at least one proximity sensor, said processor being configured to:

receive motion data from said at least one motion encoder and position data from said at least one position sensor;

send balancing moving instructions to said power drive unit, wherein said power drive unit engages in back and forth movements to maintain the robotic toy in an upright and balanced position whether the toy is additionally moving or standing stationary;

associate signals from said proximity sensor with an operation of sending predesignated moving instructions to said power drive unit, wherein either obstacles sensed or user gestures that are sensed are encoded and transmitted to said processor to cause the self-balancing robotic toy to move in user-directed fashion; and associate predefined sequences of user-manipulation of said at least one of said two coupled wheels with sending specific sequences of moving instructions to said power drive unit once a user has repositioned the wheels in contact with a surface.

2. A self-balancing robotic toy comprising:

two parallel wheels in a single axis, said two wheels being free of contact with any other parts of said toy in contact with a surface when activated;

a power drive unit, said power drive unit being independently coupled to each of said two wheels at a lower end of said robotic toy;

at least one motion encoder, said at least one motion encoder positioned for detecting position and motion of said two wheels and said power drive unit;

at least one position sensor being positioned at a determined distance above said wheels, said at least one position sensor being selected from the group consisting of inclinometers, gyroscopic sensors and inertial sensors;

at least one proximity sensor; and a processor coupled with said power drive unit and with said at least one motion encoder, said at least one position sensor and said at least one proximity sensor, said processor being configured to:

receive motion data from said at least one motion encoder and position data from said at least one position sensor;

send balancing moving instructions to said power drive unit, wherein said power drive unit engages in back and forth movements to maintain the robotic toy in an upright and balanced position whether the toy is additionally moving or standing stationary; and associate signals from said proximity sensor with an operation of sending predesignated moving instructions to said power drive unit, wherein either obstacles sensed or user gestures that are sensed are encoded and transmitted to said processor to cause the self-balancing robotic toy to move in user-directed fashion;

wherein mode selection by a user comprises the user manipulating at least one wheel in a pre-encoded sequence, wherein said robotic toy is placed into a mode of any of dancing in time to external music, moving independently and avoiding obstacles and self-operating to stay within a preselected proximity of another moving object.

3. The self-balancing robotic toy according to claim 1, further comprising mode selection by a user comprising the user manipulating both wheels in a pre-encoded sequence, wherein said robotic toy is placed into a mode of any of dancing in time to external music, moving independently and avoiding obstacles and self-operating to stay within a preselected proximity of another moving object.

* * * * *